US011270662B2

(12) United States Patent
Furihata et al.

(10) Patent No.: US 11,270,662 B2
(45) Date of Patent: Mar. 8, 2022

(54) DEVICE AND METHOD FOR BRIGHTNESS CONTROL OF DISPLAY DEVICE BASED ON DISPLAY BRIGHTNESS VALUE ENCODING PARAMETERS BEYOND BRIGHTNESS

(71) Applicant: SYNAPTICS INCORPORATED, San Jose, CA (US)

(72) Inventors: Hirobumi Furihata, Tokyo (JP); Masao Orio, Tokyo (JP); Tomoo Minaki, Tokyo (JP); Akio Sugiyama, Tokyo (JP); Kazutoshi Aogaki, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 16/748,435

(22) Filed: Jan. 21, 2020

(65) Prior Publication Data

US 2021/0225324 A1 Jul. 22, 2021

(51) Int. Cl.
*G09G 5/10* (2006.01)

(52) U.S. Cl.
CPC ..... *G09G 5/10* (2013.01); *G09G 2320/0233* (2013.01); *G09G 2320/0626* (2013.01); *G09G 2320/0673* (2013.01); *G09G 2320/0686* (2013.01)

(58) Field of Classification Search
None
See application file for complete search history.

(56) References Cited

U.S. PATENT DOCUMENTS 8,228,286 B2 * 7/2012 Choi ..... G09G 3/3406 345/102
2005/0151711 A1 * 7/2005 Baek ..... G09G 3/2003 345/88
2005/0237277 A1 * 10/2005 Kawahara ..... G09G 3/2022 345/63
2009/0284457 A1 * 11/2009 Botzas ..... G09G 3/3406 345/102
2011/0148910 A1 * 6/2011 Botzas ..... G09G 5/02 345/600
2012/0105468 A1 * 5/2012 Sasaki ..... G09G 3/3611 345/589
2013/0135272 A1 * 5/2013 Park ..... G09G 3/3233 345/211
2014/0210847 A1 * 7/2014 Knibbeler ..... H04N 9/68 345/589
2014/0300592 A1 * 10/2014 Lee ..... G09G 3/3233 345/212
2015/0206331 A1 * 7/2015 Nose ..... G06T 7/90 345/617
2015/0228215 A1 * 8/2015 Nose ..... G09G 5/04 345/590

(Continued)

*Primary Examiner* — Chad M Dicke
(74) *Attorney, Agent, or Firm* — Ferguson Braswell Fraser Kubasta PC

(57) ABSTRACT

A display driver comprises signal supply circuitry and control circuitry. The control circuitry is configured to generate a first luminance value using a DBV. The signal supply circuitry is configured to supply to a display panel at least one signal using the first luminance value. The first luminance value has a one-to-one correlation with the display brightness level. The DBV does not have a one-to-one correlation with the display brightness level.

20 Claims, 11 Drawing Sheets

(56) References Cited

U.S. PATENT DOCUMENTS

| | | | | |
|---|---|---|---|---|
| 2016/0086557 | A1* | 3/2016 | Watanabe | G09G 3/3618<br>345/691 |
| 2016/0300530 | A1* | 10/2016 | Wang | G09G 3/3216 |
| 2017/0193933 | A1* | 7/2017 | Zhang | G09G 3/36 |
| 2018/0114482 | A1* | 4/2018 | Jung | G09G 3/2014 |
| 2018/0342211 | A1* | 11/2018 | Zhang | G09G 3/34 |
| 2019/0197988 | A1* | 6/2019 | Huang | G09G 5/10 |

* cited by examiner

FIG. 5A

| DBV | DBV #0 | DBV #1 | DBV #2 | DBV #3 | DBV #4 | DBV #5 | DBV #6 | DBV #7 | DBV #8 |
|---|---|---|---|---|---|---|---|---|---|
| Gamma Settings | A | B | C | D | E | F | G | H | I |
| Emission* | 0% | 100% | 0% | 10% | 20% | 30% | 50% | 70% | 100% |
| ELVSS* | −2.4V | −2.4V | −2.4V | −2.4V | −2.4V | −2.4V | −2.4V | −3.0V | −3.5V |
| LUX | 0nit | 60nit | 2nit | 10nit | 60nit | 150nit | 300nit | 450nit | 600nit |

DEVICE AND METHOD FOR BRIGHTNESS CONTROL OF DISPLAY DEVICE BASED ON DISPLAY BRIGHTNESS VALUE ENCODING PARAMETERS BEYOND BRIGHTNESS

BACKGROUND

Field

Embodiments disclosed herein generally relate to a device and method for brightness control of a display device.

Description of the Related Art

A display brightness level of a display device may be controlled on a control value received from an external entity (e.g., a host.) Examples of the control value include a display brightness value (DBV.)

SUMMARY

In one or more embodiments, a display driver comprises signal supply circuitry and control circuitry. The control circuitry is configured to generate a first luminance value using a DBV. The signal supply circuitry is configured to supply to a display panel at least one signal using the first luminance value. The first luminance value has a one-to-one correlation with a display brightness level. The DBV does not have a one-to-one correlation with the display brightness level.

In one or more embodiments, the display device comprises a display panel and a display driver. The display driver comprises signal supply circuitry and control circuitry. The control circuitry is configured to generate a first luminance value using a DBV. The first luminance value has a one-to-one correlation with a display brightness level. The DBV does not have a one-to-one correlation with the display brightness level.

In one or more embodiments, a method comprises generating a first luminance value using a DBV and supplying at least one signal to the display panel using the first luminance value. The first luminance value has a one-to-one correlation with a display brightness level. The DBV does not have a one-to-one correlation with the display brightness level.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

FIG. 5A illustrates an example correlation of the DBV with gamma settings, an emission command value Emission*, an ELVSS command value ELVSS*, and luminance value LUX, according to one or more embodiments.

Figure 1:
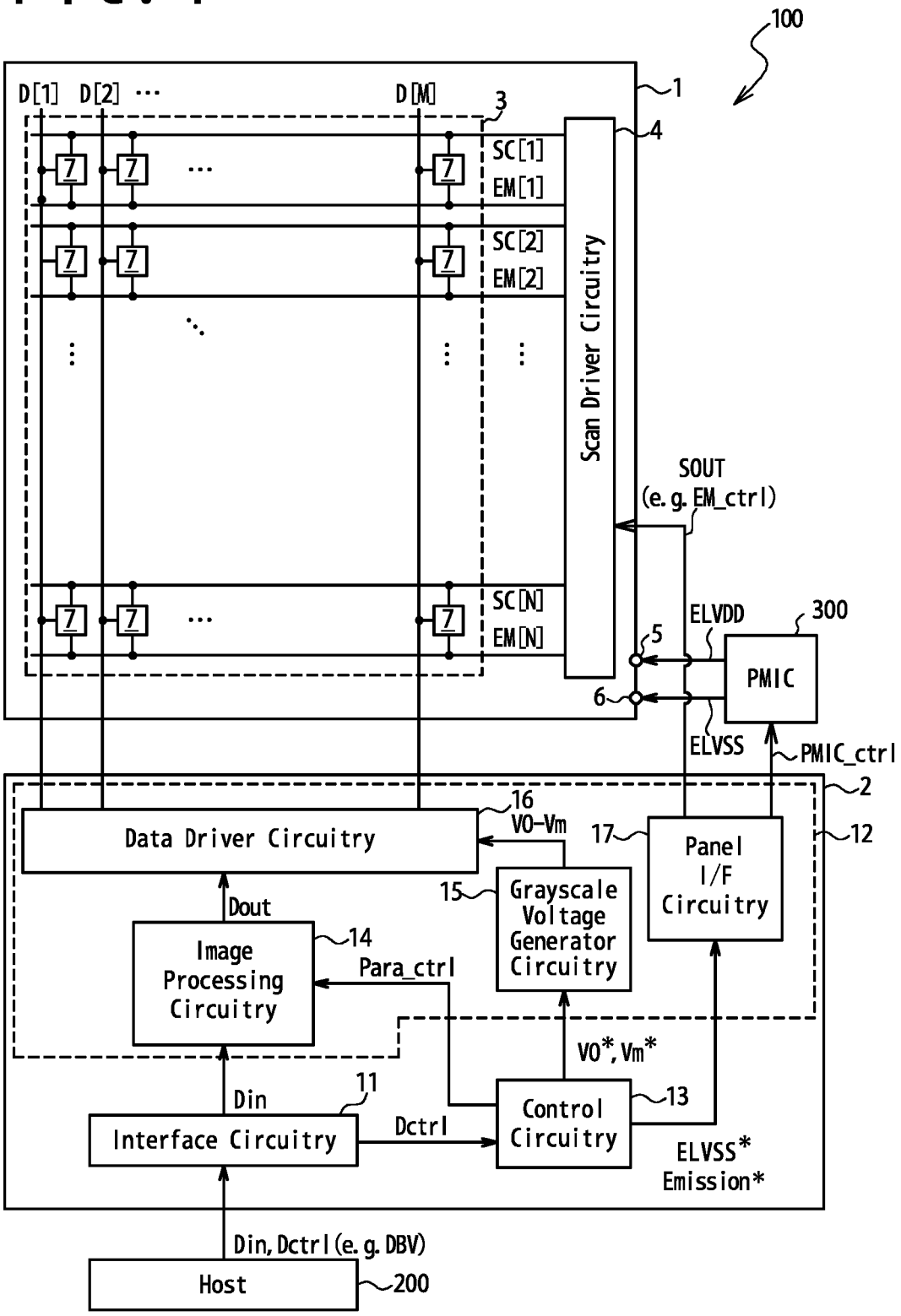
FIG. 1 illustrates an example configuration of a display device, according to one or more embodiments.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

The display brightness level of a display device may be controlled by a display brightness value (DBV) received from an external entity, such as a host. In some cases, the DBV may further comprise information other than the display brightness level. For example, the DBV may be used to control both the display brightness level and the frame rate of the display device. A DBV in a first range may indicate a first frame rate, while a DBV in a second range may indicate a second frame rate. In such cases, the DBV may not have a one-to-one correlation with the display brightness level, which in turn may lead to inappropriate control of the display brightness level. Additionally, when the DBV is not in one-to-one correlation with the display brightness level, this may result in that the display device has no valid reference that directly indicates the display brightness level. The lack of the valid reference may lead to inappropriate control of the display brightness level.

To address such drawbacks, a luminance value having a one-to-one correlation with the display brightness level may be generated using a DBV that is used to control the display brightness level but does not have a one-to-one correlation with the display brightness level. Such luminance value may simplify and improve the control of the display brightness level.

FIG. 1 illustrates an example configuration of a display device 100, according to one or more embodiments. The display device 100 may be configured to display an image corresponding to an input image data Din received from a host 200. Examples of the host 200 may include an application processor, a central processing unit (CPU) or other processors. The display device 100 includes a display panel 1 and a display driver 2. The display panel 1 may comprise a self-luminous display panel, such as an organic light emitting diode (OLED) display panel. In other embodiments, the display panel 1 may be a liquid crystal display panel. In the embodiment shown, the display panel 1 comprises a display area 3, scan driver circuitry 4, a high-side power source terminal 5, and a low-side power source terminal 6. Display area 3 includes pixel circuits 7, N scan lines SC [1] to SC [N], N emission lines EM [1] to EM [N], and M data lines D [1] to D [M] are disposed in the display area 3. The scan lines SC [1] to SC [N] and the N emission lines EM [1] to EM [N] are coupled to the scan driver circuitry 4 and the data lines D [1] to D[M] are coupled to the display driver 2. The scan lines SC [1] to SC [N] and the emission lines EM [1] to EM [N] are extended in the horizontal direction of the display panel 1, and the data lines D [1] to D [M] are extended in the vertical direction. Each pixel circuit 7 is coupled to a corresponding scan line SC, emission line EM, and data line D.

In various embodiments, the high-side power source terminal 5 and the low-side power source terminals 6 are configured to receive a high-side power source voltage ELVDD and a low-side power source voltage ELVSS from a power management integrated circuit (PMIC) 300, respectively. The high-side power source voltage ELVDD may be delivered to the respective pixel circuits 7 from the high-side power source terminal 5 via high-side power source lines (not illustrated), the low-side power source voltage ELVSS may be delivered to the respective pixel circuits 7 from the low-side power source terminal 6 via low-side power source lines (not illustrated.)

Figure 2:
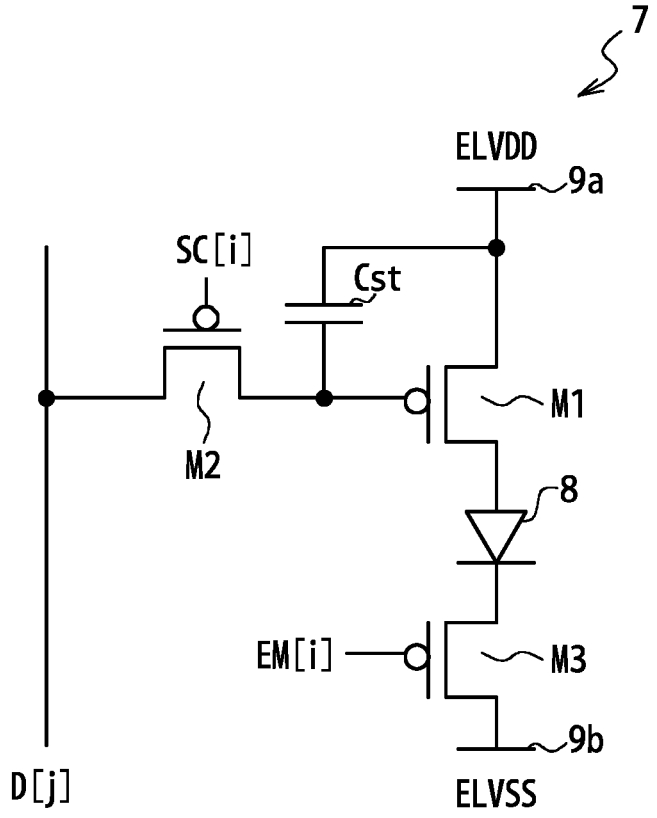
FIG. 2 illustrates an example configuration of a pixel circuit, according to one or more embodiments.

Pixel circuit 7 may be configured to emit light with a luminance level corresponding to a drive voltage received from the display driver 2. FIG. 2 illustrates an example configuration of pixel circuit 7. The pixel circuit 7 as shown comprises PMOS transistors M1 to M3, a storage capacitor Cst, and a light emitting element 8. The PMOS transistor M2 has a gate connected to the scan line SC [i] and is connected between the data line D [j] and the gate of the PMOS transistor M1. The PMOS transistor M1 has a source connected to a high-side power source node 9*a* configured to supply the high-side power source voltage ELVDD and a drain connected to a low-side power source node 9*b* configured to supply the low-side power source voltage ELVSS via the light emitting element 8 and the PMOS transistor M3. The light emitting element 8 may be an LED, OLED, or other light emitting elements suitable for the type of display panel 1. The PMOS transistor M3 has a gate connected to the emission line EM [i]. The storage capacitor Cst is connected between the gate and source of the PMOS transistor M1. The pixel circuit 7 may be configured differently than that illustrated in FIG. 2. For example, the pixel circuit 7 may be configured as a 5T2C circuit (consisting of five thin film transistors (TFTs)) and two capacitors or a 6T1C circuit (consisting of six TFTs and one capacitor).

In one or more embodiments, a write operation to program a drive voltage into a pixel circuit 7 may comprise asserting the scan line SC[i] in a state in which the emission line EM [i] is deasserted and the drive voltage is supplied to the data line D [j]. This operation achieves writing the drive voltage into the storage capacitor Cst. The storage capacitor Cst may be configured to hold a storage voltage corresponding to the drive voltage written thereinto.

In one or more embodiments, when the emission line EM [i] is deasserted, the light emitting element 8 is disconnected from the high-side power source node 9*a*, not emitting light. In one or more embodiments, when the emission line EM [i] is asserted, the light emitting element 8 emits light with a luminance level corresponding to the storage voltage across the storage capacitor Cst.

In one or more embodiments, such as the embodiment illustrated in FIG. 2, the voltage between the high-side power source node 9*a* and the gate of the PMOS transistor M1 increases as the drive voltage written into the pixel circuit 7 decreases, and the increase in voltage between the high-side power source node 9*a* and the gate of the PMOS transistor M1 increases the luminance level of the pixel circuit 7. In such embodiments, the low-side power supply voltage ELVSS is set to be lower than the allowed lowest drive voltage.

Figure 3:
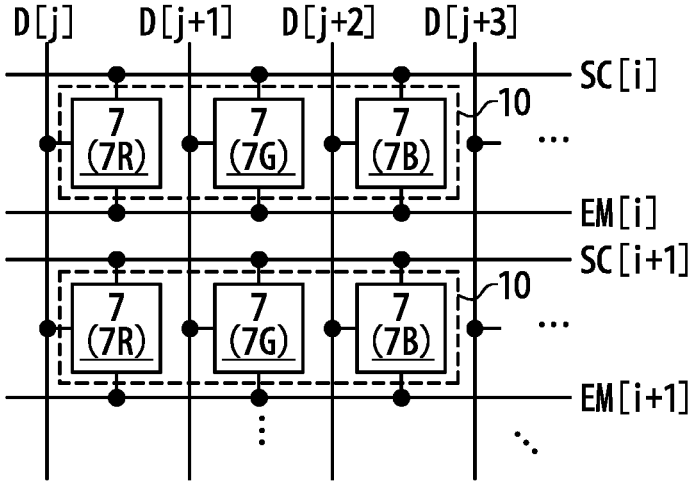
FIG. 3 illustrates an example configuration of a pixel, according to one or more embodiments.

FIG. 3 illustrates an example configuration of a pixel 10 of the display panel 1, according to one or more embodiments. Each pixel 10 comprises a plurality of pixel circuits 7 configured to display different colors, e.g., red (R), green (G), or blue (B). In various embodiments, pixel circuits 7 configured to display red, green, and blue are used as R subpixels, G subpixels, and B subpixels, respectively. The pixel circuits 7 configured to display red, green, and blue may be hereinafter referred to as R subpixel 7R, G subpixel 7G, and B subpixel 7B, respectively. Each pixel 10 may comprise at least one R subpixel 7R, at least one G subpixel 7G, and at least one B subpixel 7B. Each pixel 10 may further comprise at least one additional subpixel configured to display a color other than red, green, and blue. The combination of the colors of the subpixels of each pixel 10 is not limited to that disclosed herein. For example, each pixel 10 may further comprise a subpixel configured to display white or yellow. The display panel 1 may be configured to be adapted to subpixel rendering (SPR). In such embodiments, each pixel 10 may comprise a plurality of R subpixels 7R, a plurality of G subpixels 7G and/or a plurality of B subpixels 7B.

Referring back to FIG. 1, in one or more embodiments, the scan driver circuitry 4 is configured to drive the scan lines SC [1] to SC [N] and the emission lines EM [1] to EM [N] to select a row of pixel circuits 7 for which a write operation is performed. The scan driver circuitry 4 may be configured to, in a write operation for pixel circuits 7 located in the i-th row, for example, deassert the emission line EM [i] and assert the scan line SC [i]. The scan driver circuitry 4 may be configured to drive the scan lines SC [1] to SC [N] based on scan control signals SOUT received from the display driver 2.

In one or more embodiments, the scan control signals SOUT include an emission control signal EM_ctrl. In such embodiments, the scan driver circuitry 4 may be further configured to control, based on the emission control signal EM_ctrl, light emission from rows of pixel circuits 7 for which the write operation is not being performed. The emission control signal EM_ctrl may control a ratio of pixel circuits 7 that emit light to the pixel circuits 7 of the entire display panel 1, thereby controlling the display brightness level of the display device 100. In various embodiments, the display brightness level may be the brightness level of an entire image that is being displayed on the display panel 1.

In one or more embodiments, the emission control signal EM_ctrl is generated as a pulse-width modulated (PWM) signal and the display brightness level of the display device 100 is controlled by the duty ratio of the emission control signal EM_ctrl. The duty ratio of the emission control signal EM_ctrl may correspond to the ratio of a period during which the emission control signal EM_ctrl is asserted to one cycle period of the emission control signal EM_ctrl. In one or more embodiments, when the duty ratio of the emission control signal EM_ctrl increases, for example, the ratio of the number of asserted emission lines EM to the total number of the emission lines EM increases, and the ratio of the pixel circuits 7 that emit light also increases. This increases the display brightness level of the display device 100.

In one or more embodiments, the display driver 2 is configured to drive the display panel 1 based on input image data Din and control data Dctrl received from the host 200 to display an image corresponding to the input image data Din on the display panel 1. The input image data Din may comprise a pixel data that describes grayscale values of the respective colors of each pixel 10 of the display panel 1. The display driver 2 may comprise interface circuitry 11, signal supply circuitry 12, and control circuitry 13.

In one or more embodiments, the interface circuitry 11 is configured to receive the input image data Din and the control data Dctrl from the host 200. The interface circuitry 11 may be further configured to forward the input image data Din to the signal supply circuitry 12 and forward the control data Dctrl to the control circuitry 13. In other embodiments, the interface circuitry 11 may be configured to process the input image data Din and send the processed input image data Din to the signal supply circuitry 12.

In one or more embodiments, the signal supply circuitry 12 is configured to supply various signals to the display panel 1 based, at least in part, on the control circuitry 13. The signal supply circuitry 12 may comprise image processing circuitry 14, grayscale voltage generator circuitry 15, data driver circuitry 16, and panel interface (I/F) circuitry 17.

In one or more embodiments, the image processing circuitry 14 is configured to generate an output voltage data Dout by performing image processing on the input image data Din received from the interface circuitry 11. The output voltage data Dout may describe voltage values that specify voltage levels of drive voltages to be written into the respective pixel circuits 7 of each pixel 10 of the display panel 1.

The image processing in the image processing circuitry 14 may be controlled by control parameters Para_ctrl received from the control circuitry 13. In embodiments where the display brightness level of the display device 100 depends on the correlation between the input image data Din and the output voltage data Dout, the display brightness level of the display device 100 may be controlled by controlling the image processing with the control parameters Para_ctrl.

In one or more embodiments, the image processing circuitry 14 may be configured to perform an IR drop correction to mitigate display mura that may appear in an image displayed on the display panel 1 due to a voltage drop over the power source lines that deliver the high-side power source voltage ELVDD from the high-side power source terminal 5 to the respective pixel circuits 7, by compensating the voltage drop over the power source lines. The control parameters Para_ctrl may include amounts of the IR drop correction. The amount of IR drop may differ between respective pixel circuits 7 of each pixel 10 and may be individually determined or calculated. The IR drop correction may depend on the position of the pixel 10 of interest and the total current through the display panel 1. The total current may be the sum of the currents that flow through the pixel circuits 7 of the entire display panel 1.

Variations in the characteristics of the pixel circuits 7 may also cause display mura to appear in an image displayed on the display panel 1. Mura correction, or demura, may be performed by the image processing circuitry 14 to compensate such variations. In such embodiments, the control parameters Para_ctrl may comprise amounts of the mura correction. The correction amounts of the mura correction may be individually determined or calculated for the respective pixel circuits 7 of each pixel 10.

In one or more embodiments, the grayscale voltage generator circuitry 15 is configured to supply (m+1) grayscale voltages V0 to Vm to the data driver circuitry 16. In various embodiments, the (m+1) grayscale voltages V0 to Vm have different voltage levels from each other. In embodiments where grayscale voltage V0 is the highest grayscale voltage and grayscale voltage Vm is the lowest grayscale voltage, the intermediate grayscale voltages V1 to V(m−1) may be generated through voltage dividing of the grayscale voltages V0 and Vm. Display brightness level of the display device 100 may depend on a range of the drive voltages supplied to the pixel circuits 7. The range may have an upper limit of grayscale voltage V0 and lower limit of grayscale voltage Vm. The voltage level of the grayscale voltage V0 may be specified by a V0 command value V0* supplied from the control circuitry 13, and the voltage level of the grayscale voltage Vm may be specified by a Vm command value Vm*. In such embodiments, the display brightness level of the display device 100 can be controlled by controlling the V0 command value V0* and the Vm command value Vm*.

In one or more embodiments, the data driver circuitry 16 is configured to output, based on the output voltage data Dout from image processing circuitry 14 and grayscale voltage V0-Vm, drive voltages to be written into the respective pixel circuits 7 of the respective pixels 10 of the display panel 1. The data driver circuitry 16 may be configured to select a drive voltage to be written into each pixel circuit 7 from among the grayscale voltages V0 to Vm based on the voltage value of the output voltage data Dout associated with each pixel circuit 7. In one or more embodiments, the drive voltage to be written into each pixel circuit 7 ranges from Vm to V0 and increases as the voltage value of the output voltage data Dout increases.

In one or more embodiments, the panel interface circuitry 17 is configured to generate scan control signals SOUT to control the scan driver circuitry 4 of the display panel 1. In such embodiments, the scan driver circuitry 4 is configured to drive the scan lines SC and the emission lines EM based on the scan control signals SOUT. The scan control signal SOUT may comprise the above-mentioned emission control signal EM_ctrl. In such embodiments, the panel interface circuitry 17 may be configured to control the duty ratio of the emission control signal EM_ctrl based on the emission command value Emission* received from the control circuitry 13. For example, the duty ratio of the emission control signal EM_ctrl may increase as the emission command value Emission* increases. In embodiments where the display brightness level of the display device 100 is controllable with the emission control signal EM_ctrl, the display brightness level is controllable with the emission command value Emission*.

The panel interface circuitry 17 may be further configured to control the high-side power source voltage ELVDD and the low-side power source voltage ELVSS by supplying a PMIC control signal PMIC_ctrl to the PMIC 300. In such embodiments, the panel interface circuitry 17 may be configured to control the low-side power source voltage ELVSS based on an ELVSS command value ELVSS* received from the control circuitry 13. In one or more embodiments, the low-side power source voltage ELVSS is set lower than the lowest grayscale voltage Vm.

In one or more embodiments, the control circuitry 13 is configured to control the operation of the signal supply circuitry 12 based on the control data Dctrl received from the host 200. In various embodiments, the control data Dctrl comprises a DBV, and the control circuitry 13 is configured to control the display brightness level of the display device 100 based on the DBV. The DBV may be generated based on a user operation. For example, when an instruction to adjust the brightness of an image displayed on the display device 100 is manually input to an input device (not illustrated), the host 200 may generate the DBV based on this instruction to control the display brightness level. The input devices may be a touch panel disposed on at least a portion of the display panel 1, a cursor control device, and mechanical and/or non-mechanical buttons, among others.

In embodiments where the display brightness level of the display device 100 depends on the V0 command value V0*, the Vm command value Vm*, and the emission control value Emission*, the control circuitry 13 may be configured to generate the V0 command value V0*, the Vm command value Vm*, and the emission control value Emission* based on the DBV. The control circuitry 13 may be further configured to generate the ELVSS command value ELVSS* based on the DBV so that the low-side power source voltage ELVSS is lower than the grayscale voltage Vm.

Figure 4:
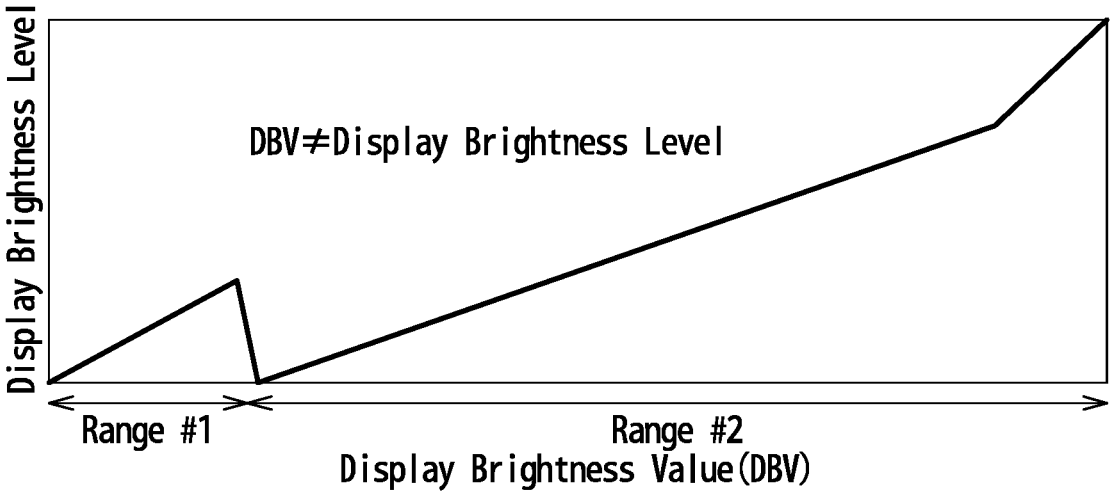
FIG. 4 illustrates an example correlation of a DBV with a display brightness level, according to one or more embodiments.

In one or more embodiments, the DBV may be used to control the display device 100 for a purpose other than the control of the display brightness level. In some embodiments, the DBV may be used to control the frame rate of the display device 100. A DBV in a first range may instruct the display driver 2 to display an image with a first frame rate (e.g., 30 Hz), and a DBV in a second range different from the first range may instruct the display driver 2 to display an image with a second frame rate (e.g., 60 Hz.) In such embodiments, the DBV is not necessarily in one-to-one correlation with the display brightness level, and may not accurately represent the display brightness level. FIG. 4 illustrates an example in which the DBV is not in one-to-one correlation with the display brightness level. In this example, the display brightness level increases as the DBV increases from zero to a predetermined level in range #1 but the display brightness level is set to zero at the lower limit of range #2. The display brightness level then increases as the DBV increases from zero to the maximum level in range #2. DBVs in range #1 may instruct the display driver 2 to display an image with a first frame rate (e.g., 30 Hz), and DBVs in range #2 may instruct the display driver 2 to display an image with a second frame rate (e.g., 60 Hz) different than the first frame rate. In one or more embodiments, the control circuitry 13 is configured to generate, based on the DBV, a luminance value LUX that has one-to-one correlation with the display brightness level, whereas the DBV does not have one-to-one correlation with the display brightness level. In such embodiments, the luminance value LUX may represent the desired display brightness level more accurately than the DBV, and therefore enables more accurate control of the display brightness level of the display device. The control circuitry 13 may be configured to control the display brightness level so that the display brightness level increases monotonically with the luminance value LUX. The control circuitry 13 may be configured to control the display brightness level so that the display brightness level increases proportionally with luminance value LUX.

In one or more embodiments, the control circuitry 13 may comprise a correlation table correlating the DBV with gamma settings, the emission command value Emission*, the ELVSS command value ELVSS*, and the luminance value LUX. FIG. 5A illustrates example contents of the correlation table. Gamma settings "A" to "I" may each comprise set values of the V0 command value V0* and the Vm command value Vm*. The control circuitry 13 may generate the V0 command value V0*, the Vm command value Vm*, the emission command value Emission*, the ELVSS command value ELVSS*, and the luminance value LUX through a table lookup based on the DBV. For example, for DBV #0, the control circuitry 13 may select gamma settings "A", set the emission command value Emission* to 0%, set the ELVSS command value ELVSS* to −2.4V, and set the luminance value to 0 nit.

Referring back to FIG. 1, the control circuitry 13 may be configured to control the signal supply circuitry 12 and/or image processing circuitry 14 based on the luminance value LUX. For example, the control circuitry 13 may be configured to control the image processing in the image processing circuitry 14 using control parameters Para_ctrl generated using the luminance value LUX. In embodiments where the image processing circuitry 14 is adapted to the IR drop correction, the control circuitry 13 may be configured to control the IR drop correction based on the luminance value LUX, for example, by generating an IR drop correction amount based on the luminance value LUX. In embodiments where the image processing circuitry 14 is adapted to the mura correction, the control circuitry 13 may be configured to control the mura correction based on the luminance value LUX, for example, by generating a mura correction amount based on the luminance value LUX.

Figure 5B:
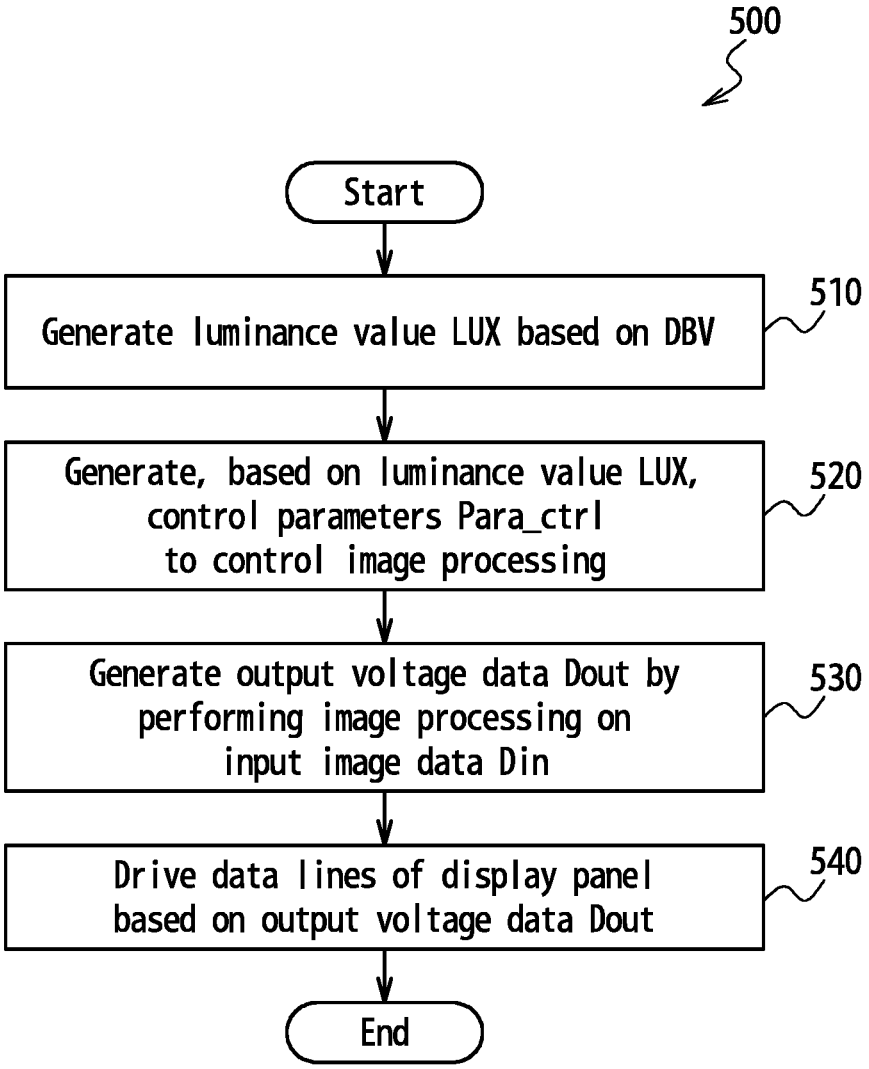
FIG. 5B illustrates an example method of driving a display panel, according to one or more embodiments.

Method 500 of FIG. 5B illustrates steps for driving the display panel 1 in one or more embodiments. At step 510, the control circuitry 13 generates the luminance value LUX based on the DBV received from the host 200. At step 520, the control circuitry 13 generates the control parameters Para_ctrl based on the luminance value LUX to control the image processing in the image processing circuitry 14. In embodiments where the image processing comprises an IR drop correction, the IR drop correction may be performed based on the luminance value LUX. In embodiments where the image processing comprises a mura correction, the mura correction may be performed based on the luminance value LUX. At step 530, the image processing circuitry 14 generates the output voltage data Dout by performing the image processing on the input image data Din based on the control parameters Para_ctrl. At step 540, the data driver circuitry 16 drives the data lines D [1] to D [m] based on the output voltage data Dout.

Figure 6:
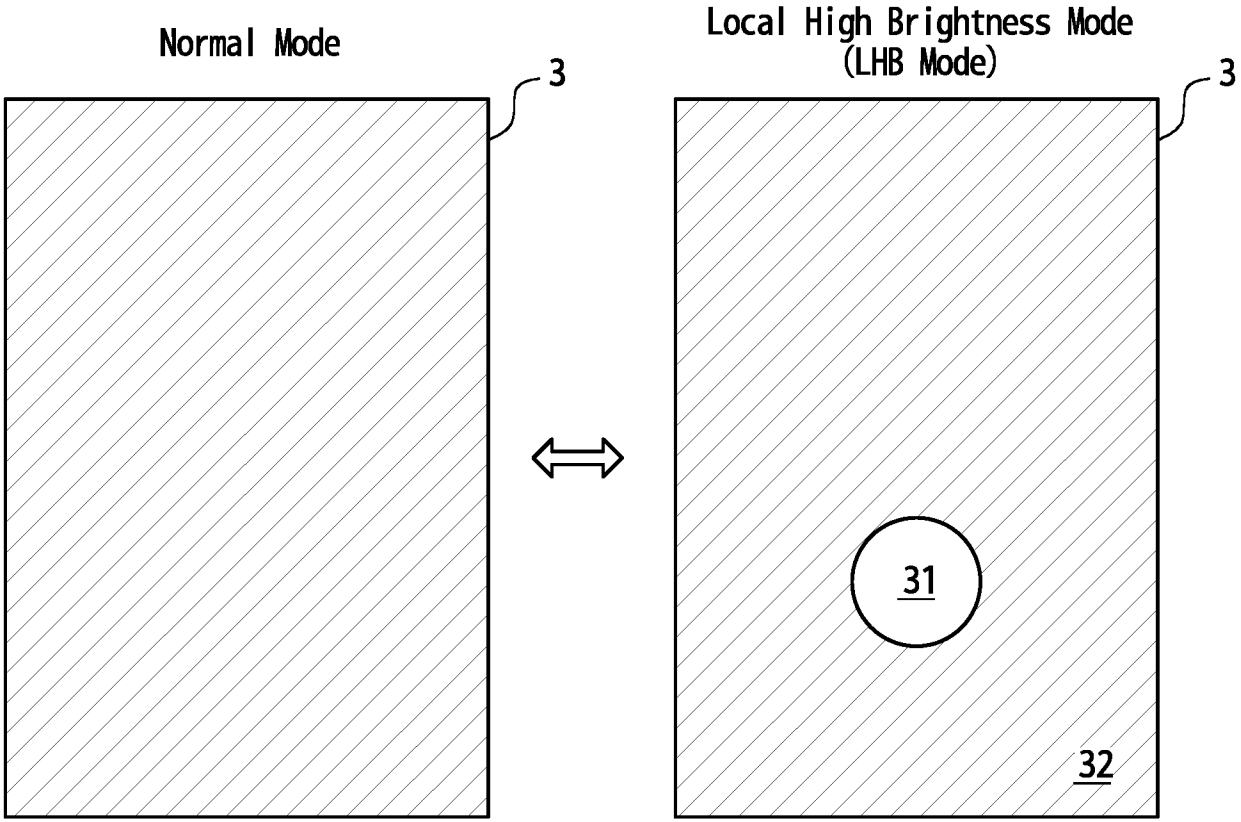
FIG. 6 illustrates an example of a local high brightness (LHB) mode, according to one or more embodiments.

In one or more embodiments, the display device 100 is configured to be adapted to a local high brightness (LHB) mode. As illustrated in FIG. 6, when the display device 100 is placed into the LHB mode, a high brightness area 31 in which the brightness level is increased is disposed in the display area 3 of the display panel 1 in one or more embodiments. In various embodiments, the brightness level of an outside area 32 of the display area 3 positioned outside of the high brightness area 31 is maintained at the brightness level before the display device 100 is placed into the LHB mode. In one or more embodiments, the high brightness area 31 disappears when the display device 100 is returned to a normal mode.

In one or more embodiments, the control circuitry 13 is configured to control, in the LHB mode, the grayscale voltage V0, Vm, the low-side power source voltage ELVSS, and the emission control signal EM_ctrl to display an image with a high brightness level, for example, the highest brightness level in the high brightness area 31. For example, the control circuitry 13 may be configured to, when the display device 100 is placed into the LHB mode, decrease the lowest grayscale voltage Vm and the low-side power source voltage ELVSS and increase the duty ratio of the emission control signal EM_ctrl.

In one or more embodiments, the control circuitry 13 is further configured to control the image processing in the image processing circuitry 14 in the LHB mode to maintain the brightness level of the outside area 32. The decreases in the grayscale voltage Vm and the low-side power source voltage ELVSS and the increase in the duty ratio of the emission control signal EM_ctrl may increase the brightness level of the entire display area 3. In one or more embodiments, the control circuitry 13 is configured to maintain the brightness level in the outside area 32 by cancelling the increase in the brightness level of the entire display area 3 through a control of the image processing performed on the input image data Din associated with pixels 10 located in the outside area 32.

Figure 7:
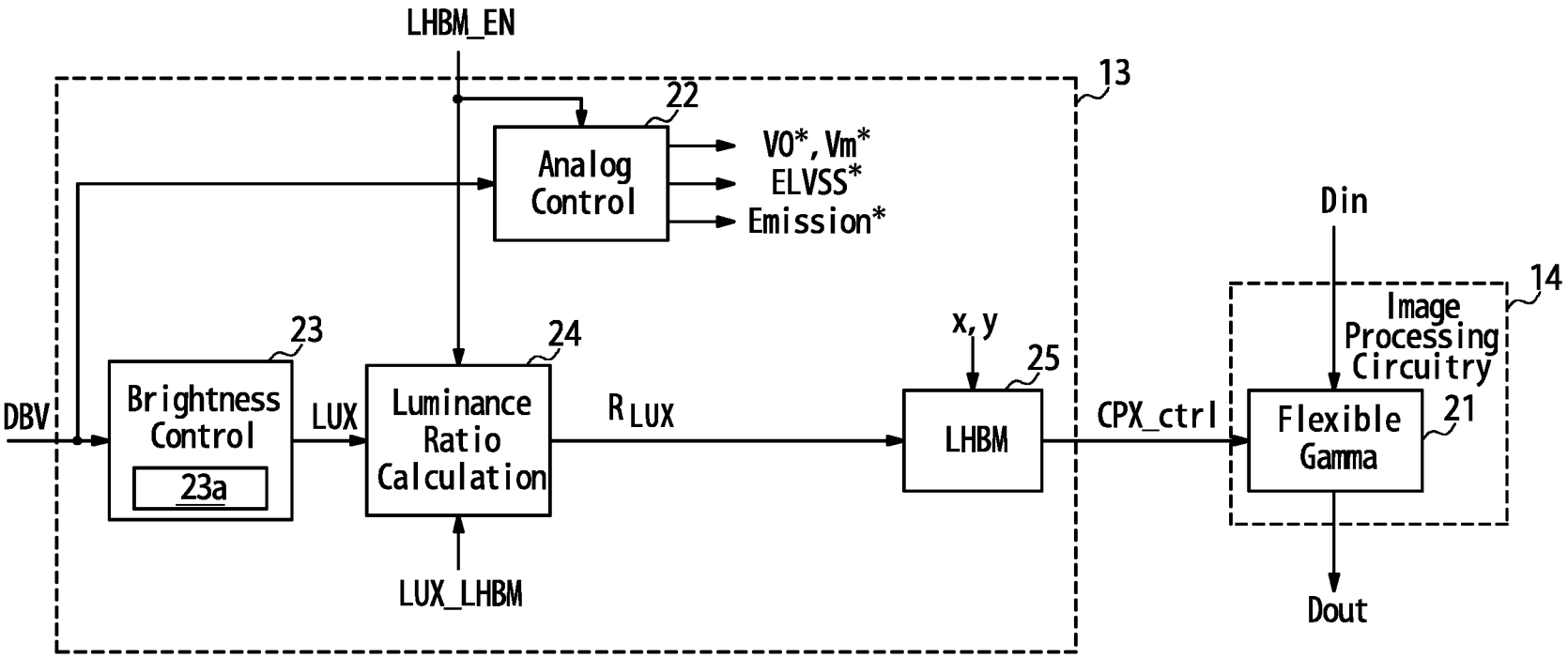
FIG. 7 illustrates example configurations of control circuitry and image processing circuitry, according to one or more embodiments.

In one or more embodiments, as illustrated in FIG. 7, the control circuitry 13 and the image processing circuitry 14 are configured to be adapted to the controls of the grayscale voltages V0, Vm, the low-side power source voltage ELVSS, the emission control signal EM_ctrl, and the image processing for the LHB mode.

The image processing circuitry 14 may comprise flexible gamma circuitry 21 configured to generate the output voltage data Dout based on the input image data Din. In various embodiments, the output voltage data Dout may be generated so that the correlation between the luminance level of light emitted by a pixel circuit 7 and the grayscale value described in the input image data Din is in accordance with gamma characteristics represented by a gamma value γ. In this meaning, the processing performed by the flexible gamma circuitry 21 may be referred to as "gamma processing." The gamma value γ may be set to 2.2, for example.

Figure 8:
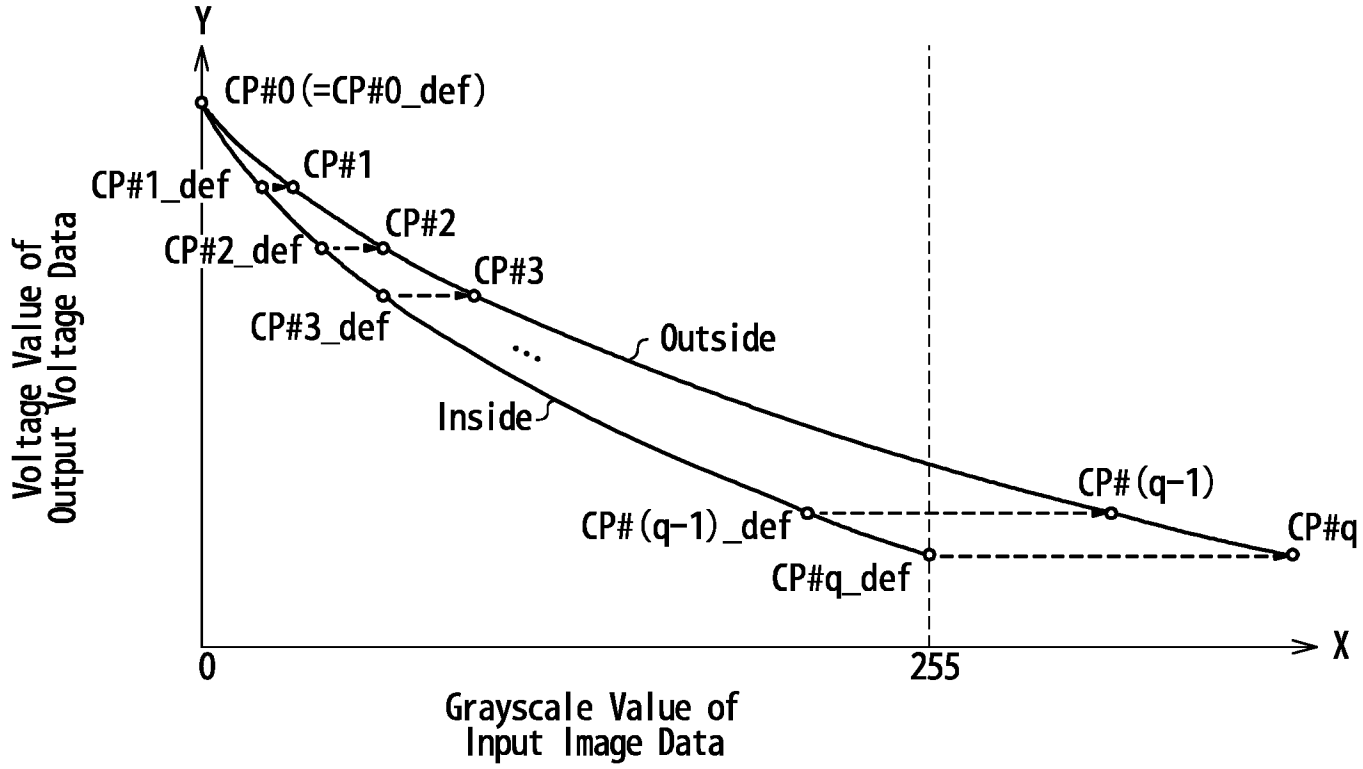
FIG. 8 illustrates an example correlation of an input image data with an output voltage data, according to one or more embodiment.

In one or more embodiments, as illustrated in FIG. 8, the input-output property of the flexible gamma circuitry 21, that is, the correlation between the grayscale value of the input image data Din and the voltage value of the output voltage data Dout is represented by a gamma curve presented in a coordinate system defined with first and second coordinate axes, where the first coordinate axis represents the grayscale value of the input image data Din and the second coordinate axis represent the voltage value of the output voltage data Dout. In FIG. 8, the first coordinate axis is illustrated as the X axis, and the second coordinate axis is illustrated as the Y axis. The flexible gamma circuitry 21 may be configured to calculate the voltage value of the output voltage data Dout as the Y coordinate of a point on the gamma curve, the point has an X coordinate equal to the grayscale value of the input image data Din.

In various embodiments, the shape of the gamma curve is specified with a set of control points CP #0 to CP #q, where q is an integer of two or more. The gamma curve may be a free-form curve (e.g., a Bezier curve) with a shape specified by the control points CP #0 to CP #q. The positions of the control points CP #0 to CP #q may be represented by coordinates in the coordinate system. The coordinates of the control point CP #i may be hereinafter referred to as (CPXi, CPYi), where CPXi is the coordinate on the first coordinate axis or the X axis of the control point CP #i, and CPYi is the coordinate on the second coordinate axis or the Y axis of the control point CP #i. CPXi and CPYi may be hereinafter referred to as X coordinate CPXi and Y coordinate CPYi, respectively.

In one or more embodiments, the flexible gamma circuitry 21 is configured to memorize the shape of a default gamma curve in the form of the coordinates of default control points CP #0 to CP #q. The default control points CP #0 to CP #q may be hereinafter denoted as CP #0_def to CP #q_def, respectively, and the X coordinate and Y coordinate of the default control point CP #i_def may be denoted as CPXi_def and CPYi_def, respectively.

In one or more embodiments, the flexible gamma circuitry 21 is configured to adjust the X coordinates CPX0 to CPXq of the control points CP #0 to CP #q used for generation of a voltage value of the output voltage data Dout. This enables generating a gamma curve used for the generation of the voltage value of the output voltage data Dout by scaling the default gamma curve in the direction parallel to the first coordinate axis or the X axis. In one or more embodiments, the flexible gamma circuitry 21 is configured to calculate the coordinates of the control points CP #0 to CP #q used for the generation of the voltage value of the output voltage data Dout based on the coordinates of the default control points CP #0_def to CP #q_def and a control parameter CPX_ctrl received from the control circuitry 13, where the control parameter CPX_ctrl controls the X coordinate CPXi of the control points CP #i. For example, the X coordinate CPXi of the control point CP #i may be calculated as the product of the X coordinate CPXi_def of the default control point CP #i_def and the control parameter CPX_ctrl. In such embodiments, the gamma curve is enlarged by CPX_ctrl times in the direction parallel to the first coordinate axis or the X axis. In one or more embodiments, when the gamma curve is enlarged in the direction parallel to the first coordinate axis or the X axis, the voltage value of the output voltage data Dout is increased which in turn increases the drive voltage supplied to the pixel circuit 7. In such embodiments, the luminance level of the pixel circuit 7 decreases when the gamma curve is enlarged in the direction parallel to the first coordinate axis or the X axis. In one or more embodiments, the default Y coordinate CPYi_def is used as the Y coordinate CPYi of the control point CP #i without modification.

Referring back to FIG. 7, in one or more embodiments, the control circuitry 13 is configured to generate the luminance value LUX based on the DBV and generate the control parameter CPX_ctrl based on the luminance value LUX. This configuration offers control of the gamma curve based on the luminance value LUX. In various embodiments, the control circuitry 13 comprises analog control circuitry 22, brightness control circuitry 23, luminance ratio calculation circuitry 24, and local high brightness mode (LHBM) circuitry 25.

In one or more embodiments, the analog control circuitry 22 is configured to generate the V0 command value V0*, the Vm command value Vm*, the emission command value Emission*, and the ELVSS command value ELVSS* based on the DBV. The analog control circuitry 22 may comprise a table that describe a correlation of the DBV with the V0 command value V0*, the Vm command value Vm*, the emission command value Emission*, and the ELVSS command value ELVSS* as illustrated in FIG. 5A. In such embodiments, the analog control circuitry 22 may be configured to generate the V0 command value V0*, the Vm command value Vm*, the emission command value Emission*, and the ELVSS command value ELVSS* through a table lookup based on the DBV.

In one or more embodiments, the V0 command value V0*, the Vm command value Vm*, the emission command value Emission*, and the ELVSS command value ELVSS* are further generated based on an LHBM enable signal LHBM_EN. The LHBM enable signal LHBM_EN may indicate whether the display device 100 is placed in the LHB mode. The LHBM enable signal LHBM_EN may be asserted when the display device 100 is placed in the LHB mode. The display device 100 may be placed in the LHB mode based on an instruction received from the host 200.

In one or more embodiments, the analog control circuitry 22 may be configured to, when the LHBM enable signal LHBM_EN is asserted, set the V0 command value V0*, the Vm command value Vm*, the emission command value Emission*, and the ELVSS command value ELVSS* so that an image can be brightly displayed in the display area 3 of the display panel 1. This enables brightly displaying the image in the high brightness area 31. For example, the analog control circuitry 22 may be configured to, when the display device 100 is placed into the LHB mode, set the Vm command value Vm*, the emission command value Emission*, and the ELVSS command value ELVSS* to decrease the lowest grayscale value Vm and the low-side power source voltage ELVSS and increase the duty ratio of the emission control signal EM_ctrl. The analog control circuitry 22 may be configured to, when the LHBM enable signal LHBM_EN is asserted, set the V0 command value V0*, the Vm command value Vm*, the emission command value Emission*, and the ELVSS command value ELVSS* so that the image can be displayed most brightly.

In one or more embodiments, the brightness control circuitry 23 is configured to generate the luminance value LUX based on the DBV. The brightness control circuitry 23 may comprise a brightness control table 23*a* that describes a correlation between the DBV and the luminance value LUX. In such embodiments, the brightness control circuitry 23 may be configured to generate the luminance value LUX through a table lookup on the brightness control table 23*a* based on the DBV.

In one or more embodiments, the luminance ratio calculation circuitry 24 is configured to calculate a luminance ratio $R_{LUX}$ based on the luminance value LUX received from the brightness control circuitry 23, an LHBM luminance value LUX_LHBM, and the LHBM enable signal LHBM_EN, where the LHBM luminance value LUX_LHBM is a predetermined value representing the brightness level in the high brightness area 31. In one or more embodiments, the luminance ratio $R_{LUX}$ represents a degree to reduce the brightness levels of pixels 10 positioned in the outside area 32 in the gamma processing in the flexible gamma circuitry 21. The luminance ratio $R_{LUX}$ may be a positive value less than or equal to one.

The luminance ratio calculation circuitry 24 may be configured to set the luminance ratio $R_{LUX}$ to "1" when the LHBM enable signal LHBM_EN is deasserted. In such embodiments, the gamma processing by the flexible gamma circuitry 21 does not reduce the brightness of the image regardless of the position of the pixel 10 of interest when the display device 100 is placed in the normal mode.

The luminance ratio calculation circuitry 24 may be configured to calculate the luminance ratio $R_{LUX}$ as the ratio of the luminance value LUX to the LHBM luminance value LUX_LHBM when the LHBM enable signal LHBM_EN is asserted. In such embodiments, the luminance ratio $R_{LUX}$ in the LHB mode is represented by the following equation (1):

$$R_{LUX}=\text{LUX}/\text{LUX_LHBM}. \quad (1)$$

In one or more embodiments, the flexible gamma circuitry 21 is configured to, when the display device 100 is placed in the LHB mode, perform the gamma processing so that the brightness level of the image is reduced by $R_{LUX}$ times in the outside area 32.

In one or more embodiments, the LHBM circuitry 25 is configured to control the shape of the gamma curve by generating the control parameter CPX_ctrl based on the luminance ratio $R_{LUX}$ and the coordinates x and y of the pixel 10 of interest of the gamma processing in the flexible gamma circuitry 21, where the coordinates x and y indicate the position of the pixel 10 of interest in the display area 3. The control of the shape of the gamma curve may be achieved by controlling the X coordinates CPX0 to CPXq of the control points CP #0 to CP #q.

The LHBM circuitry 25 may be configured to unconditionally set the control parameters CPX_ctrl to "1" when the LHBM enable signal LHBM_EN is deasserted and the luminance ratio $R_{LUX}$ is accordingly set to "1." In such embodiments, when the display device 100 is placed in the normal mode, the flexible gamma circuitry 21 uses the default control points CP #0_def to CP #q_def in the gamma processing, not reducing the brightness level of the image in the gamma processing regardless of the position of the pixel 10 of interest.

In one or more embodiments, the LHBM circuitry 25 is configured to, when the LHBM enable signal LHBM_EN is asserted to set the luminance ratio $R_{LUX}$ to LUX/LUX_LHBM, selectively set the control parameter CPX_ctrl to "1" or a value calculated to be less than "1" based on the luminance ratio $R_{LUX}$.

In various embodiments, the LHBM circuitry 25 is configured to set to the control parameter CPX_ctrl to "1" when determining based on the coordinates x and y of the pixel 10 of interest that the pixel 10 of interest is positioned in the high brightness area 31. In this case, the X coordinates CPX0 to CPXq of the control points CP #0 to CP #q are set to the default X coordinates CPX0_def to CPXq_def. In such embodiments, the gamma processing is performed in accordance with the default gamma curve, which is indicated by "Inside" in FIG. 8, for pixels 10 located in the high brightness area 31 when the display device 100 is placed in the LHB mode.

In various embodiments, the LHBM circuitry 25 is configured to set the control parameter CPX_ctrl to enlarge the gamma curve in a direction parallel to the first coordinate axis or the X axis when determining that the pixel 10 of interest is positioned in the outside area 32. This allows the flexible gamma circuitry 21 to perform the gamma processing to reduce the brightness level of the image in the outside area 32. In one or more embodiments, the degree of the enlargement of the gamma curve in the gamma processing for the pixels 10 positioned in the outside area 32 is controlled to cancel the increase of the brightness level caused by the control of the lowest grayscale voltage Vm, the low-side power source voltage ELVSS, and/or the duty ratio of the emission control signal EM_ctrl. For example, the control parameter CPX_ctrl may be set to enlarge the gamma curve so that the luminance levels of the pixel circuits 7 of the pixels 10 positioned in the outside area 32 are reduced by $R_{LUX}$ times. In embodiments where the X coordinates CPX0 to CPXq of the control points CP #0 to CP #q are calculated as the products of the default X coordinates CPX0_def to CPXq_def and the control parameter CPX_ctrl, respectively, the luminance levels of the pixel circuits 7 of the pixels 10 positioned in the outside area 32 can be reduced by $R_{LUX}$ (<1) times by calculating the control parameter CPX_ctrl in accordance with the following equation (2):

$$CPX_ctrl=1/R_{LUX}^{1/\gamma}, \quad (2)$$

where γ is the gamma value set to the display device 100, for example, 2.2. In embodiments where the control parameter CPX_ctrl is calculated in accordance with expression (2), the gamma curve is enlarged by $1/R_{LUX}^{1}N$ times in the direction parallel to the first coordinate axis or the X axis as indicated by "Outside" in FIG. 8. This reduces the luminance levels of the pixel circuits 7 by $R_{LUX}$ (<1) times.

As thus discussed, the control circuitry 13 illustrated in FIG. 7 is configured to increase the brightness level of the image in the high brightness area 31 with the brightness level of the image maintained in the outside area 32 when the display device 100 is placed in the LHB mode.

Figure 9:
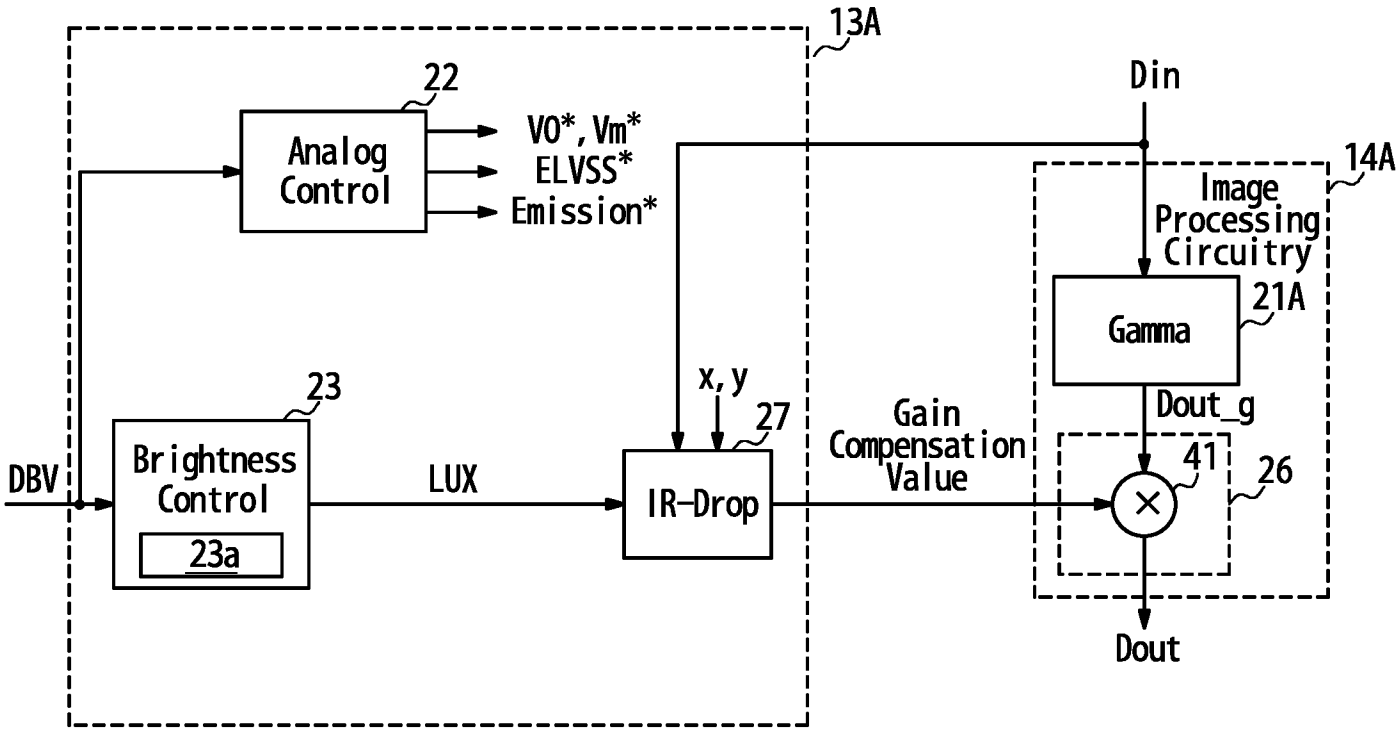
FIG. 9 illustrates example configurations of control circuitry and image processing circuitry, according to one or more embodiments.

In one or more embodiments, as illustrated in FIG. 9, control circuitry 13A and image processing circuitry 14A are configured to be adapted to an IR drop connection to compensate a voltage drop over the power source lines that deliver the high-side power source voltage ELVDD to the respective pixel circuits 7 from the high-side power source terminal 5. In such embodiments, the image processing circuitry 14A may comprise gamma circuitry 21A and correction circuitry 26.

In one or more embodiments, the gamma circuitry 21A is configured to generate a gamma-processed voltage data Dout_g by performing gamma processing on the input image data Din. In various embodiments, the gamma-processed voltage data Dout_g is generated so that the correlation between the luminance level of light emitted by a pixel circuit 7 and the grayscale value described in the input image data Din is in accordance with gamma characteristics represented by a gamma value γ. The gamma value γ may be set to 2.2, for example.

In one or more embodiments, the correction circuitry 26 is configured to generate the output voltage data Dout by correcting the gamma-processed voltage data Dout_g based on correction amounts of the IR drop correction received from the control circuitry 13A. The correction amounts of the IR drop correction may comprise gain compensation values calculated to compensate the voltage drop over the power source lines that deliver the high-side power source voltage ELVDD to the respective pixel circuits 7 from the high-side power source terminal 5. In such embodiments, the correction circuitry 26 may comprise a multiplier 41 configured to generate an output voltage data Dout associated with each pixel circuit 7 of each pixel 10 by multiplying the gamma-processed voltage data Dout_g associated with each pixel circuit 7 by the gain compensation value calculated for each pixel circuit 7.

In one or more embodiments, the control circuitry 13A is configured to generate the luminance value LUX based on the DBV and generate correction amounts or gain compensation values of the IR drop correction based on the generated luminance value LUX. This operation achieves the IR drop correction based on the luminance value LUX. The control circuitry 13A may comprise IR drop correction circuitry 27 in addition to the above-described analog control circuitry 22 and brightness control circuitry 23.

In one or more embodiments, the IR drop correction circuitry 27 is configured to generate gain compensation values for the respective pixel circuits 7 of the pixel 10 of interest based on the luminance value LUX, the coordinates x, y of the pixel 10 of interest, and the input image data Din. The voltage drop over the power source lines that deliver the high-side power source voltage ELVDD to the respective pixel circuits 7 from the high-side power source terminal 5 may depend on the total current through the display panel 1 and the distance of the pixel 10 of interest from the high-side power source terminal 5. In one or more embodiments, the total current through the display panel 1 may be the sum of the currents that flow through the respective pixel circuits 7, and the currents that flow through the respective pixel circuits 7 may depend on the display brightness level and the input image data Din.

In view of this, in one or more embodiments, the IR drop correction circuitry 27 is configured to calculate the total current through the display panel 1 based on the luminance value LUX and the input image data Din and generate the gain compensation values of the respective pixel circuits 7 of the pixel 10 of interest based on the calculated total current and the coordinates x and y of the pixel 10 of interest. In such embodiments, the total current through the display panel 1 can be calculated more accurately with a more simplified calculation compared to a calculation of the total current based on the DBV, since the luminance value LUX is in one-to-one correlation with the display brightness level. This may improve the accuracy of the IR drop correction.

Figure 10:
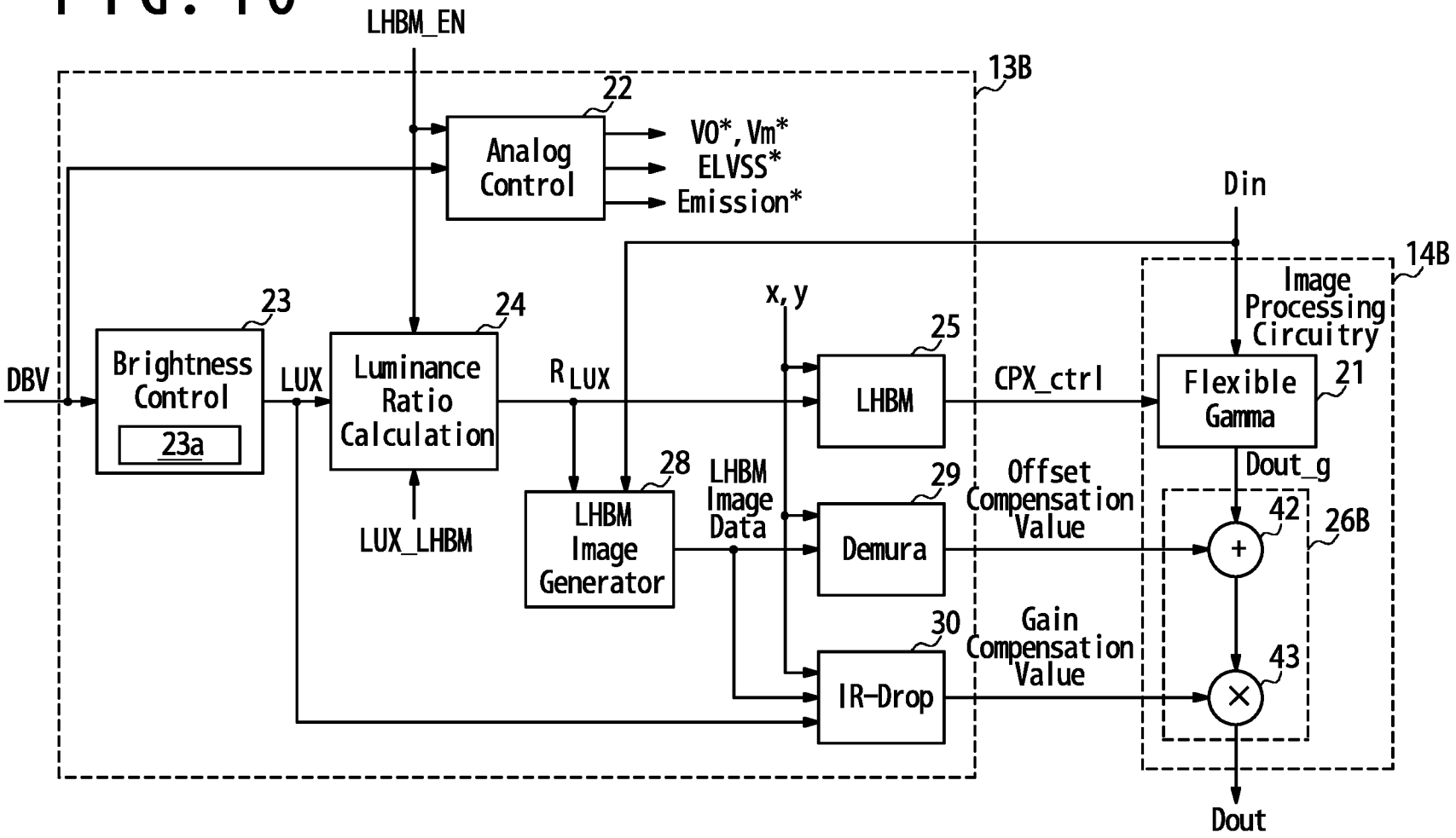
FIG. 10 illustrates example configurations of control circuitry and image processing circuitry, according to one or more embodiments.

In one or more embodiments, as illustrated in FIG. 10, control circuitry 13B and image processing circuitry 14B are configured to be adapted to the LHB mode, the IR drop correction and the mura correction. In such embodiments, the image processing circuitry 14B may comprise correction circuitry 26B in addition to the flexible gamma circuitry 21 described in relation to FIG. 8.

In one or more embodiments, the correction circuitry 26B is configured to generate the output voltage data Dout by correcting the gamma-processed voltage data Dout_g received from the flexible gamma circuitry 21 based on correction amounts of the IR drop correction and the mura correction received from the control circuitry 13B. The correction amounts of the IR drop correction may comprise a gain compensation value calculated to compensate the voltage drop over the power source lines that deliver the high-side power source voltage ELVDD to the respective pixel circuits 7 from the high-side power source terminal 5. The correction amounts of the mura correction may comprise an offset compensation value calculated to compensate variations in the characteristics of the pixel circuits 7. In one or more embodiments, the correction circuitry 26B comprises an adder 42 and a multiplier 43. In such embodiments, the adder 42 and the multiplier 43 may be configured to calculate a voltage value of the output voltage data Dout by adding the offset compensation value to the voltage value of the gamma-processed voltage data Dout_g and further multiplying the resultant value by the gain compensation value.

In one or more embodiments, the control circuitry 13B is configured to generate the luminance value LUX based on the DBV and further generate, based on the luminance value LUX, a control parameter CPX_ctrl supplied to the flexible gamma circuitry 21, an offset compensation value supplied to the adder 42, and a gain compensation value supplied to the multiplier 43. The control circuitry 13B may comprise LHBM image generator circuitry 28, mura correction circuitry 29, and IR drop correction circuitry 30 in addition to the analog control circuitry 22, the brightness control circuitry 23, the luminance ratio calculation circuitry 24, and the LHBM circuitry 25, which are described in relation to FIG. 7.

In one or more embodiments, the LHBM image generator circuitry 28 is configured to generate an LHBM image data based on the input image data Din and the luminance ratio $R_{LUX}$ received from the luminance ratio calculation circuitry 24. In various embodiments, the LHBM image data is generated to represent electrical states of the respective pixel circuits 7 of the display panel 1 when the display device 100 is placed in the LHB mode. When the display device 100 is placed in the LHB mode, the input image data Din may incorrectly reflect the electrical states of the respective pixel circuits 7 of the display panel 1, since the flexible gamma circuitry 21 performs image processing to reduce the brightness levels of the pixels 10 positioned in the outside area 32. Examples of the electrical states may include the voltage levels of the drive voltages and the levels of the currents flowing through the light emitting elements 8.

The LHBM image data may comprise pixel data associated with the pixels 10 in the high brightness area 31 and pixel data associated with the pixels 10 in the outside area 32. In one or more embodiments, when the display device 100 is placed in the LHB mode, the pixel data of the LHBM image data associated with the pixels 10 in the outside area 32 are generated based on the luminance ratio $R_{LUX}$ and the pixel data of the input image data Din associated with the pixels 10 in the outside area 32. The pixel data of the LHBM image data associated with the pixels 10 in the outside area 32 may be generated by performing image processing on the pixel data of the input image data Din associated with the pixels 10 in the outside area 32 to reduce the brightness levels of the respective pixels 10 by $R_{LUX}$ times. In other embodiments, the pixel data of the LHBM image data associated with the pixels 10 in the outside area 32 may be generated by multiplying the grayscale values of the respective colors of the pixel data of the input image data Din associated with the pixels 10 in the outside area 32 by $1/R_{LUX}{}^{1}N$. In one or more embodiments, when the display device 100 is placed in the LHB mode, the pixel data of the input image data Din associated with the pixels 10 in the high brightness area 31 are used as the pixel data of the LHBM image data associated with the pixels 10 in the high brightness area 31 without modification. The LHBM image data thus generated may well reflect the electrical states of the respective pixel circuits 7 of the display panel 1 when the display device 100 is placed in the LHB mode. In one or more embodiments, when the display device 100 is not placed in the LHB mode, the luminance ratio $R_{LUX}$ is set to "1" and accordingly the LHBM image data is generated to be identical to the input image data Din.

In one or more embodiments, the mura correction circuitry 29 is configured to calculate correction amounts or offset compensation values of the mura correction or demura based on the LHBM image data and the coordinate x and y of the pixel 10 of interest. The mura correction circuitry 29 may be configured to store correction parameters associated with the respective pixel circuits 7 of the respective pixels 10 and select the correction parameters associated with the respective pixel circuits 7 of the pixel 10 of interest based on the coordinates x and y of the pixel 10 of interest. The mura correction circuitry 29 may be further configured to calculate the correction amounts or offset compensation values of the mura correction for the respective pixel circuits 7 of the pixel 10 of interest based on the selected correction parameters and the pixel data of the LHBM image data associated with the pixel 10 of interest. An appropriate correction amount or offset compensation value of the mura correction for a pixel circuit 7 of a pixel 10 may depend on the drive voltage supplied to the pixel circuit 7. The calculation of the correction amounts or offset compensation values of the mura correction based on the LHBM image data may improve the accuracy of the mura correction, since the LHBM image data may well reflect the drive voltages supplied to the respective pixel circuits 7 of the respective pixels 10.

In one or more embodiments, the IR drop correction circuitry 30 is configured to generate correction amounts or gain compensation values of the IR drop compensation based on the LHBM image data, the luminance value LUX, and the coordinates x and y of the pixel 10 of interest. The IR drop correction circuitry 30 may be configured to calculate the total current through the display panel 1 based on the luminance value LUX and the LHBM image data and generate the gain compensation values of the respective pixel circuits 7 of the pixel 10 of interest based on the calculated total current and the coordinates x and y of the pixel 10 of interest. The calculation of the correction amounts or gain compensation values of the IR drop correction based on the LHBM image data may improve the accuracy of the IR drop correction, since the LHBM image data may well reflect the currents that flow through the light emitting elements 8 of the respective pixel circuits 7 of the respective pixels 10.

In other embodiments, the IR drop correction is not implemented. In such embodiments, the IR drop correction circuitry 30 may be removed, and the output of the adder 42 may be used as the output voltage data Dout. In other embodiments, the mura correction is not implemented. In such embodiments, the mura correction circuitry 29 may be removed, and the gamma-processed voltage data Dout_g may be used as the input of the multiplier 43 to generate the output voltage data Dout.

While various embodiments have been specifically described herein, a person skilled in the art would appreciate that the technologies disclosed herein may be implemented with various modifications.

What is claimed is:

1. A display driver comprising:

control circuitry configured to:

receive a display brightness value (DBV), based on the DBV, generate:

a first luminance value configured to control a display brightness level of a display panel driven by the display driver, and a display frame rate of the display panel, wherein the DBV is configured to be in any of a plurality of ranges comprising a first range and a second range, wherein, the DBV, in the first range:

sets the display frame rate to a first frame rate, and controls the display brightness level to increase as the DBV increases within the first range, and wherein the DBV, in the second range different from the first range:

sets the display frame rate to a second frame rate different from the first frame rate, and controls the display brightness level to increase as the DBV increases within the second range; and signal supply circuitry configured to supply at least one signal to the display panel using the first luminance value and the display frame rate, wherein the first luminance value has a one-to-one correlation with the display brightness level, and wherein the DBV does not have a one-to-one correlation with the display brightness level.

2. The display driver of claim 1, wherein the signal supply circuitry comprises image processing circuitry configured to process image data using the first luminance value, and wherein the at least one signal is based on at least in part the processed image data.

3. The display driver of claim 2, wherein processing the image data comprises:

determining a shape of a gamma curve with control points in a coordinate system; and controlling positions of the control points based on the first luminance value.

4. The display driver of claim 3, wherein controlling the positions of the control points comprises determining a ratio of the first luminance value to a second luminance value that is greater than or equal to the first luminance value.

5. The display driver of claim 1, wherein the signal supply circuitry comprises image processing circuitry configured to perform an IR drop correction based on the first luminance value.

6. The display driver of claim 5, wherein the control circuitry is further configured to determine an amount of the IR drop correction based on a ratio of the first luminance value to a second luminance value that is greater than or equal to the first luminance value.

7. The display driver of claim 6, wherein determining the amount of the IR drop correction comprises:

generating a local high brightness mode (LHBM) image data based on input image data and the ratio of the first luminance value to the second luminance value; and determining the amount of the IR drop correction based on the LHBM image data.

8. The display driver of claim 7, wherein generating the LHBM image data comprises:

using pixel data of the input image data associated with pixels in a high brightness area in a display area of the display panel as pixel data of the LHBM image data associated with the pixels in the high brightness area; and generating pixel data of the LHBM image data associated with the pixels in an area outside of the high brightness area based on the pixel data of the input image data associated with the pixels in the area outside of the high brightness area and the ratio of the first luminance value to the second luminance value.

9. The display driver of claim 1, wherein, the control circuitry is further configured to control a mura correction using the first luminance value when the display driver is in a local high brightness mode (LHBM).

10. The display driver of claim 9, wherein controlling the mura correction comprises determining an amount of the mura correction based on a ratio of the first luminance value to a second luminance value that represents a brightness level of a high brightness area in a display area of the display panel.

11. The display driver of claim 10, wherein determining the amount of the mura correction comprises:

generating LHBM image data based on input image data and the ratio of the first luminance value to the second luminance value; and determining the amount of the mura correction based on the LHBM image data.

12. A display device comprising:

a display panel; and a display driver comprising:

control circuitry configured to:

receive a display brightness value (DBV), based on the DBV, generate:

a first luminance value configured to control a display brightness level of a display panel driven by the display driver, and a display frame rate of the display panel, wherein the DBV is configured to be in any of a plurality of ranges comprising a first range and a second range, wherein, the DBV, in the first range:

sets the display frame rate to a first frame rate, and controls the display brightness level to increase as the DBV increases within the first range, and wherein the DBV, in the second range different from the first range:

sets the display frame rate to a second frame rate different from the first frame rate, and controls the display brightness level to increase as the DBV increases within the second range; and signal supply circuitry configured to supply at least one signal to the display panel using the first luminance value and the display frame rate, wherein the first luminance value has a one-to-one correlation with the display brightness level, and wherein the DBV does not have a one-to-one correlation with the display brightness level.

13. The display device of claim 12, wherein the signal supply circuitry comprises image processing circuitry configured to process image data using the first luminance value, and wherein the at least one signal is based at least in part on the processed image data.

14. The display device of claim 13, wherein processing the image data comprises:

determining a shape of a gamma curve with control points in a coordinate system; and controlling positions of the control points based on the first luminance value.

15. The display device of claim 14, wherein controlling the positions of the control points comprises determining a ratio of the first luminance value to a second luminance value that is greater than or equal to the first luminance value.

16. The display device of claim 12, wherein the signal supply circuitry comprises image processing circuitry configured to perform an IR drop correction based on the first luminance value.

17. A method, comprising:

receiving a display brightness value (DBV)

based on the DBV, generating:

a first luminance value configured to control a display brightness level of a display panel driven by the display driver, and a display frame rate of the display panel, wherein the DBV is configured to be in any of a plurality of ranges comprising a first range and a second range, wherein, the DBV, in the first range:

sets the display frame rate to a first frame rate, and controls the display brightness level to increase as the DBV increases within the first range, and wherein the DBV, in the second range different from the first range:

sets the display frame rate to a second frame rate different from the first frame rate, and controls the display brightness level to increase as the DBV increases within the second range; and supplying at least one signal to the display panel using the first luminance value and the display frame rate, wherein the first luminance value has a one-to-one correlation with the display brightness level, and wherein the DBV does not have a one-to-one correlation with the display brightness level.

18. The method of claim 17, wherein supplying the at least one signal to the display panel comprises processing image data using the first luminance value, wherein the at least one signal is based on at least in part the processed image data.

19. The method of claim 18, wherein processing the image data comprises:

determining a shape of a gamma curve with control points in a coordinate system; and controlling positions of the control points based on the first luminance value.

20. The method of claim 17, wherein supplying the at least one signal to the display panel comprises:

performing an IR drop correction based on the first luminance value.

* * * * *